United States Patent [19]

Reichert et al.

[11] 4,448,464

[45] May 15, 1984

[54] COOLING APPLIANCE, ESPECIALLY A HOUSEHOLD REFRIGERATOR OR THE LIKE

[75] Inventors: Rudolf Reichert; Theo Haftlmeier, both of Giengen, Fed. Rep. of Germany

[73] Assignee: Bosch-Siemens Hausgeräte, Stuttgart, Fed. Rep. of Germany

[21] Appl. No.: 344,926

[22] Filed: Feb. 2, 1982

[30] Foreign Application Priority Data

Feb. 5, 1981 [DE] Fed. Rep. of Germany ..... 3104012

[51] Int. Cl.[3] ..... F25D 11/00

[52] U.S. Cl. ..... 312/214; 312/322; 312/326

[58] Field of Search ..... 312/214, 236, 120, 123, 312/125, 133, 11, 59, 14, 186, 238, 322, 326; 16/246, 331, 333, 325; 292/17

[56] References Cited

U.S. PATENT DOCUMENTS

| | | | |
|---|---|---|---|
| 593,636 | 11/1897 | Bamberger | 312/326 |
| 2,074,546 | 3/1937 | Hartman | 312/326 |
| 2,104,939 | 1/1938 | Whalen | 312/322 |
| 2,558,602 | 6/1951 | Atchison | 312/322 |
| 2,593,233 | 4/1952 | White | 312/214 |
| 2,955,892 | 10/1960 | Pulaski et al. | 312/326 |
| 3,101,227 | 8/1963 | Pugh | 312/326 |
| 3,167,186 | 1/1965 | Squire | 312/326 |
| 3,633,783 | 1/1972 | Aue | 312/214 |
| 3,989,328 | 11/1976 | Nonomaque et al. | 312/214 |
| 4,168,871 | 9/1979 | Dierkes | 312/313 |

*Primary Examiner*—Victor N. Sakran

*Attorney, Agent, or Firm*—Herbert L. Lerner; Laurence A. Greenberg

[57] ABSTRACT

Cooling appliance, including a housing having an opening formed therein, a solid outer layer, an inner lining having a surface facing the outer layer, and hard synthetic foam being foamed in situ between said inner lining and outer layer, at least one lockable door covering the opening, a mounting rail being embedded in the synthetic foam on the surface of the inner lining, a first bearing part fixed on the mounting rail in vicinity of the opening, a second bearing part being movably disposed on the first bearing part, and at least one supporting tray being disposed in the housing and having a given region being disposed on the second bearing part, the supporting tray having a curved portion opposite the given region for permitting the tray to be at least partly swung out of the housing with the door open.

9 Claims, 3 Drawing Figures

COOLING APPLIANCE, ESPECIALLY A HOUSEHOLD REFRIGERATOR OR THE LIKE

Figure 1:
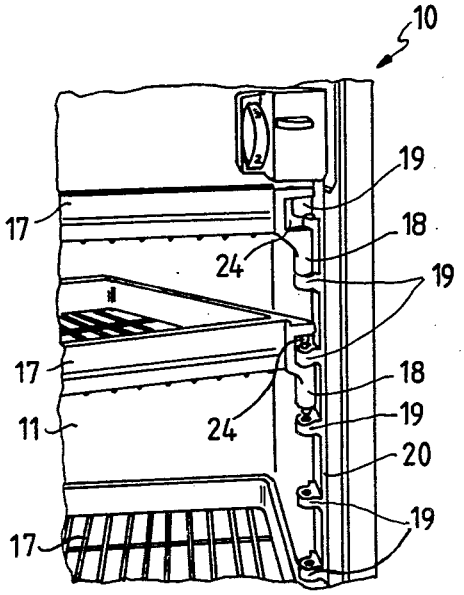

The invention relates to cooling appliances, especially household refrigerators or the like, having a housing including a hard synthetic foam being foamed in situ between an inner lining and a solid outer layer, at least one door for locking the housing, and at least one supporting tray disposed in the interior of the housing, the tray having a bearing part movably disposed on a fixed bearing part seated close to the door opening, preferably on the abutment side housing wall, and the tray having its side opposite the fixed bearing being curved to the extent that, with the door open, it can be at least partially swung out of the housing.

With cooling appliances such as these, the supporting trays which can be swung out exert a high torque on their bearings and also on the walls and the entire housing of the cooling appliance, because of their one-sided type of bearing. This is particularly the case if the supporting trays are loaded with relatively heavy goods to be cooled such as canned goods, full liquid containers, and those goods to be cooled which are kept in heavy dishes, or the like.

Known cooling appliances such as these are therefore equipped with a columnar or prismatic carrier disposed on the abutment side housing wall, close to the door opening; the carrier being provided with a screw thread, and having the bearings of a plurality of supporting trays disposed thereon, which are height-adjustably superposed on each other by means of threaded nuts. This known construction, however, requires many individual parts. It is therefore too complex and expensive. Aside from this, the columnar carrier takes up a considerable amount of space in the interior of the refrigerator housing, and in that way obstructs the operation of the cooling appliance, and the cleaning maintenance of the housing.

With another known cooling appliance, a solution that is substantially improved over that of the above-mentioned conventional construction is accomplished, be attaching a T-shaped profile rod to the housing sidewall, into the crossbar thereof a row of holes being superposed on top of each other. The height-adjustable supporting tray bearings are inserted on the projecting ends of this crossbar in one of its holes by pivot means. Even with this known construction a relatively great amount of singular parts are still required. Furthermore, the device suffers the drawback of single supporting trays only being removable from the housing if prior to that any supporting trays disposed above it are removed from the top end of the profile rod by consecutively stripping them off. Moreover, the direct type of attachment of the profile rod to the sidewall of the housing requires a particularly heavy and stable construction of the cooling device.

It is accordingly an object of the invention to provide a cooling appliance, especially a household refrigerator or the like, which overcomes the hereinafore-mentioned disadvantages of the heretofore-known devices of this general type, to simplify and improve on the mounting of supporting trays, and to adapt this mounting to the special conditions only given by thin surface-lined household refrigerators having hard synthetic foam heat insulator housings, by taking simple structural measures.

With the foregoing and other objects in view there is provided, in accordance with the invention, a cooling appliance, especially a household refrigerator or the like, comprising a housing having an opening formed therein, a solid outer protective layer, an inner lining having a back surface facing said outer layer, and hard synthetic foam being foamed in situ between the inner lining and outer layer, at last one lockable door covering the opening, a mounting rail being embedded in the synthetic foam on the back surface of the inner lining, a first bearing part fixed on the mounting rail in vicinity of the opening, preferably on the abutment side housing wall, a second bearing part being movably disposed on the first bearing part, and at least one supporting tray being disposed in the housing and having a given region being disposed on the second bearing part, the supporting tray having a curved portion opposite the given region for permitting the tray to be at least partly swung out of the housing with the door open.

By means of this mounting rail embedded in the hard synthetic foam, the advantages derived from operating household refrigerators by using pivotable supporting trays can also be applied to current-model household refrigerators having a relatively lightweight housing.

In accordance with another feature of the invention, the mounting rail is U-shaped and has outwardly angled legs formed thereon and a cross piece disposed against the surface of the inner lining. A mounting rail constructed in this way has an especially safe and solid anchoring base in the hard synthetic foam, and therefore also is able to absorb higher loads without risking the danger of damaging the housing in the process.

In accordance with a further feature of the invention, the first bearing part includes at least two mutually spaced apart side by side bearing blocks having bearing eyes formed therein, the second bearing part being vertically hooked in the eyes. A bearing according to the invention is especially suitable for absorbing the torque exerted by a supporting tray under a heavy load, and despite this for assuring an easy pivoting motion thereof.

In accordance with an added feature of the invention, there is provided a continuous strip, the first bearing part including a plurality of bearing blocks being mutually spaced apart on the strip one above the other and having bearing eyes formed therein at locations matching the location of the second bearing part.

In accordance with an additional feature of the invention, the plurality of bearing blocks disposed on the strip are mutually spaced apart at a distance matching the height of the second bearing part.

In accordance with again another feature of the invention, the mounting rail has a vertical shoulder forming an abutment in the inner lining, and the continuous strip has an edge facing inside the housing lying against the shoulder.

In accordance with again a further feature of the invention, the housing has a curved section in a corner being untouched by the tray when it is swung into the housing, and including at least one other tray being disposed in the corner matching the curved section.

In accordance with again an added feature of the invention, the at least one other tray is in the form of a tray being associated with each of the at least one supporting tray, the at least one tray being height adjustably and detachably mounted in the housing.

In accordance with a concomitant feature of the invention, the at least one other tray has a front edge at which the other tray is pivotably mounted in vicinity of the opening of the housing, and including articulating rods connected from the supporting tray to the other tray for swinging the other tray with the supporting tray.

Other features which are considered as characteristic for the invention are set forth in the appended claims.

Although the invention is illustrated and described herein as embodied in a cooling applicance, especially a household refrigerator or the like, it is nevertheless not intended to be limited to the details shown, since various modifications and structural changes may be made therein without departing from the spirit of the invention and within the scope and range of equivalents of the claims.

Figure 2:
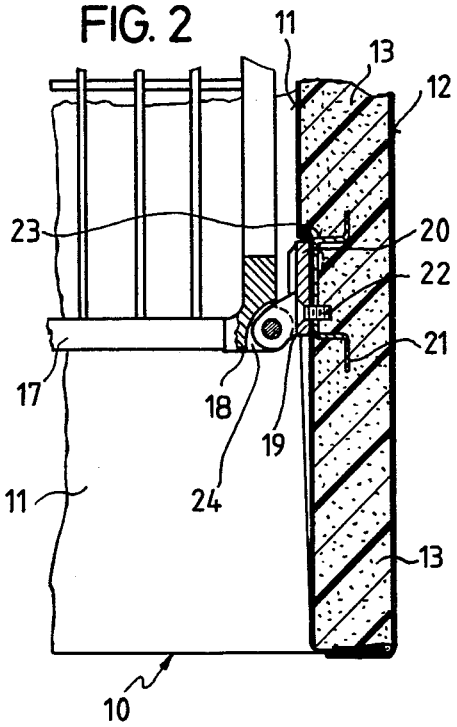
Figure 3:
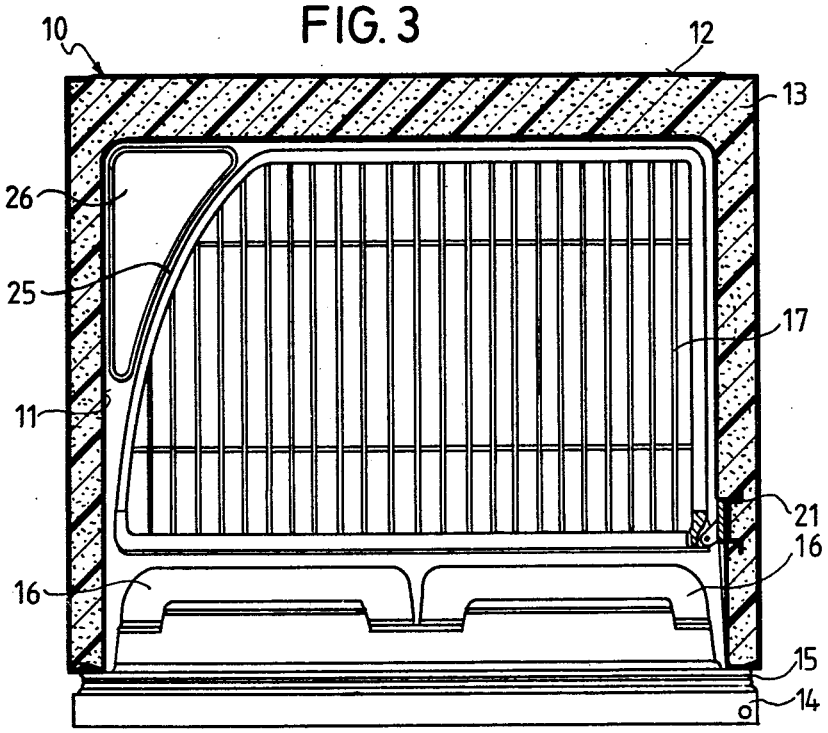

The construction and method of operation of the invention, however, together with additional objects and advantages thereof will be best understood from the following description of specific embodiments when read in connection with the accompanying drawings, in which:

FIG. 1 is a fragmentary, diagrammatic, front elevational view of the doorside of a refrigerator housing, having a plurality of supporting trays being superposed above each other and being outwardly pivotably mounted on a ridge, which has bearing blocks and is seated on the sidewall close to the door opening;

FIG. 2 is a fragmentary, partially cross-sectional view, being partly broken away and being on an enlarged scale as compared to FIG. 1, through an abutment housing wall having a fixed bearing part mounted thereon which in turn has a supporting tray pivotably mounted thereon by means of a movable bearing part; and FIG. 3 is a cross-sectional view from above through a household refrigerator equipped with a pivotable supporting tray.

Referring now particularly to FIGS. 1–3 as a whole, it is seen that reference symbol 10 designates the housing of a household refrigerator, which includes a foamed rigid-expanded or hard foam synthetic material 13 conventionally formed in situ between an inner lining 11 and a solid outer protective layer 12. The housing 10 can be locked by a door 14, having a flexible magnetic seal 15 disposed on the edge thereof. With the door closed, the seal is tightly applied to the opening edge of the housing 10. On the inside of the door 14, as is customary, there are various bins or compartments 16 fitted with a lock, e.g., having covers disposed thereon that are able to be swung up, with the door closed these compartments project into the interior of the housing.

In the interior of the housing there is a plurality of mutually superposed supporting trays 17, which are formed by wire grating with an edge or border surrounding it. In the case at hand, with the door open, the supporting trays are outwardly pivotable from the door opening of the housing 10, and have a movable bearing part 18 in their front corner being associated with the abutment wall of the housing 10, the bearing part 18 being hung into a fixed bearing part seated on the abutment housing wall close to the door opening. The fixed bearing part includes a plurality of bearing blocks or brackets 19 being superposed on each other at uniform interspacings, and in the illustrated embodiment being seated on a continuous adhering strip 20. This strip 20 carrying the fixed bearing blocks 19, is mounted on a mounting rail 21, which is embedded in the hard synthetic or plastic foam 13 and is disposed on the rear side of the inner lining 11 of the housing 10 or the side facing the layer 12. The rail 21 is formed in a U-shape with outwardly angled legs, and has a cross piece applied against the rear side of the inner lining 11, that is against the surface of the lining facing the layer 12. As shown in the illustrated embodiment, countersunk screws 22 are used for mounting the strip; thereaded bolts thereof being screwed into threaded holes in the mounting rail strip.

In its final assembly, the strip 20, carrying the fixed bearing parts 19, has its edge facing the interior of the housing disposed against a vertical shoulder 23, which serves as a limit stop in the inner lining of housing 10.

The movable bearing part disposed at the front abutment corner of the supporting tray 17 is equipped with a cut away portion 24, in which a bearing block of the fixed bearing part 19 is engaged. The height of this cut away portion 24 is so dimensioned that the movable bearing part with its pivot suspension can be lifted from the bearing eyes in the bearing blocks 19 by raising it. The movable bearing part 18 is downwardly extended by a plug so that a higher torque can be absorbed.

As shown specifically in FIG. 3, the supporting trays 17 have their side disposed diametrically opposite the movable bearing part constructed to form a curved section 25, which enables the supporting tray, which takes up the full width of the housing 10 with its front side, to pivot outwardly from the housing. Into the interior area of the housing being untouched by the curved section 25 of the tray 17, a correspondingly-shaped tray 26 is inserted, this tray is mounted on the housing wall in a height-adjustable and detachable way. Each tray 17 is matched with at least one tray 26.

By deviating from the illustrated and described embodiment, a provision can also be made for pivotably mounting the tray 26 around its front corner in the housing 10 facing the opening thereof. A further provision which can be made is for the tray 26 to be coupled with the tray 17 by articulating rods, drawbars or shackle lines, which are hinged to the trays, so that upon an outward swing of the tray 17 associated with the tray 26, the tray 26 can also be swung forward.

The trays 17 being constructed as described and illustrated above, can be detached from the fixed bushing part 19 in an especially simple way by lifting them, as shown with reference to the central tray 17 in FIG. 1, to the extent of having the bearing pivots emerge from the bearing block holes of the fixed bearing part 19. A tray lifted in this way then can be easily set at a higher or lower position by using its movable bushing part 18 for hooking itself into the bearing blocks of the bearing part 19 disposed above or below.

We claim:

1. Cooling appliance, comprising a housing having an opening formed therein, a solid outer layer, an inner lining having a surface facing said outer layer, and hard synthetic foam being foamed in situ between said inner lining and outer layer, at least one lockable door covering said opening, a mounting rail being embedded in said synthetic foam on said surface of said inner lining, at least one first bearing part fixed on said mounting rail in vicinity of said opening, at least one second bearing part being movably disposed on said at least one first bearing part, and at least one supporting tray being disposed in said housing and having a given region being disposed on said at least one second bearing part, said supporting tray having a curved portion opposite said given region for permitting said tray to be at least partly swung out of said housing with said door open.

2. Cooling appliance according to claim 1, wherein said mounting rail is U-shaped and has outwardly angled legs formed thereon and a cross piece disposed against said surface of said inner lining.

3. Cooling appliance according to claim 1 or 2, wherein said first bearing part includes at least two mutually spaced apart bearing blocks having bearing eyes formed therein, said second bearing part being vertically hooked in said eyes.

4. Cooling appliance according to claim 1, including a continuous strip, said first bearing part including a plurality of bearing blocks being mutually spaced apart on said strip one above the other and having bearing eyes formed therein at locations matching the location of said second bearing part.

5. Cooling appliance according to claim 4, wherein said plurality of bearing blocks disposed on said strip are mutually spaced apart at a distance matching the height of said second bearing part.

6. Cooling appliance according to claim 4 or 5, wherein said mounting rail has a vertical shoulder forming an abutment in said inner lining, and said continuous strip has an edge facing inside said housing lying against said shoulder.

7. Cooling appliance according to claim 1, wherein said housing has a curved section in a corner being untouched by said tray when it is swung into said housing, and including at least one other tray being disposed in said corner matching said curved section.

8. Cooling appliance according to claim 7, wherein said at least one other tray is in the form of a tray being associated with each of said at least one supporting tray, said at least one tray being height adjustably and detachably mounted in said housing.

9. Cooling appliance according to claim 1, wherein said given region of each supporting tray is connected to one respective second bearing part.

* * * * *